US005834398A

United States Patent [19]

Mochizuki et al.

[11] Patent Number: 5,834,398

[45] Date of Patent: Nov. 10, 1998

[54] SUBLIMATION THERMAL TRANSFER RECEIVING MATERIAL AND IMAGE FORMING METHOD THEREFOR

[75] Inventors: Hidehiro Mochizuki, Numazu; Yutaka Ariga, Fujinomiya; Makoto Sekiyama; Shinya Kawahara, both of Numazu, all of Japan

[73] Assignee: Ricoh Company, Ltd., Tokyo, Japan

[21] Appl. No.: 789,558

[22] Filed: Jan. 27, 1997

[30] Foreign Application Priority Data

Feb. 2, 1996 [JP] Japan ..... 8-040709

[51] Int. Cl.[6] ..... B41M 5/035; B41M 5/38

[52] U.S. Cl. ..... 503/227; 428/195; 428/211; 428/423.1; 428/480; 428/500; 428/522; 428/913; 428/914

[58] Field of Search ..... 8/471; 428/195, 428/211, 423.1, 480, 500, 522, 913, 914; 503/227

[56] References Cited

U.S. PATENT DOCUMENTS

| | | | |
|---|---|---|---|
| 5,348,931 | 9/1994 | Mochizuki et al. | 503/227 |
| 5,376,619 | 12/1994 | Mochizuki et al. | 503/227 |
| 5,525,573 | 6/1996 | Uemura et al. | 503/227 |

*Primary Examiner*—Bruce H. Hess
*Attorney, Agent, or Firm*—Cooper & Dunham, LLP

[57] ABSTRACT

A sublimation thermal transfer receiving material having an image receiving layer is provided for sublimation thermal transfer recording, wherein the image receiving layer including a resin having activated hydrogen, an isocyanate compound and a catalyst promoting the crosslinking reaction of said resin and said isocyanate compound, and wherein a degree of gelation of the image receiving layer is about 70 to 99% and the isocyanate compound includes one of a xylylene diisocyanate compound and an aliphatic isocyanate compound excepting an adduct of hexamethylene diisocyanate. The receiving material is preferably subjected to a heat treatment after being formed an image thereon.

21 Claims, 1 Drawing Sheet

SUBLIMATION THERMAL TRANSFER RECEIVING MATERIAL AND IMAGE FORMING METHOD THEREFOR

BACKGROUND OF THE INVENTION

1. Field of the Invention

The present invention relates to a sublimation thermal transfer receiving material and an image forming method therefor. More particularly, the present invention relates to a sublimation thermal transfer receiving material having good recording qualities and good durability of a recorded image when used for n-fold speed mode multiple thermal transfer recording.

2. Discussion of the Related Art

Recently, the demand for full color printing has increased year by year. There have been known various recording methods for full color printing including electrophotographic recording methods, ink jet recording methods and thermal transfer recording methods. Among these methods, thermal transfer recording methods are widely employed because of advantages such as good image quality, high speed printing, and easy operation and maintenance.

In sublimation thermal transfer recording, an image can be obtained on a sublimation thermal transfer receiving material (referred to as a receiving material) upon application of heat to the backside of a sublimation thermal transfer recording material (referred to as a recording material) whose ink layer contacts a receiving layer of the receiving material. The sublimation thermal transfer recording material includes a substrate and an ink layer which is formed on the substrate and includes a thermo-diffusional dye (hereinafter referred to as a sublimable dye) dispersed in a binder resin. When heat is applied to the recording material, the sublimable dye diffuses into the receiving layer of the receiving material, so that an image is formed on the receiving material.

However, the sublimation thermal transfer recording method costs more than other methods, because:

(a) sublimable dye is relatively expensive;

(b) yellow, magenta, cyan, and, when necessary, black image recording materials, each individually being of equal size to the recorded image, are needed to obtain a full color image; and (c) used recording material must be disposed of even though there may be a large unused portions of the recording material.

To obviate these shortcomings, so-called multiple sublimation thermal transfer recording methods have been proposed. The multiple sublimation thermal transfer recording methods include the n-times (n is at least 2) mode multiple recording method and the n-fold (n is more than 1 and generally from 5 to 20) speed mode multiple recording method.

In the n-times mode multiple recording method, a recording material is repeatedly recorded n-times while being fed at the same feeding speed as the receiving material.

In the n-fold speed mode multiple recording method by contrast, a recording material is recorded while being fed at a feeding speed of 1/n that of the receiving material.

The image recorded by the n-fold speed mode multiple recording method is superior to an image recorded by the n-times mode multiple recording method because of advantages such as satisfactory evenness of the recorded image and no wrinkling of the recording material in recording.

The properties which a receiving material should have for n-fold multiple thermal transfer recording are as follows:

(1) none sticking to the recording material, (2) high image density, and (3) good durability, particularly to light.

In attempting to obtain these properties, a variety of receiving materials have been disclosed. For example, a receiving material is disclosed which has a receiving layer including a reaction product of a vinyl chloride-vinyl alcohol copolymer and a polyisocyanate compound (Japanese Patent Publication No. 4-62877) or which has a receiving layer including a reaction product of a derivative of a vinyl chloride-vinyl propionate copolymer and a polyisocyanate compound (Japanese Laid-Open Patent Application No. 4-153091). These receiving materials are useful for a normal sublimation thermal transfer recording method (referred to as a normal recording method) in which the feeding speed of a recording material and a receiving material is the same. However, these receiving materials tend to stick on a recording material when used in an n-fold speed mode multiple sublimation thermal transfer recording method (referred to as a multiple recording method). This is because the reaction products have poor resistance to friction force generated between the recording material and the receiving material due to insufficient crosslinking density of the reaction products. In these cases, if these receiving materials are aged in a high temperature environment to increase crosslinking density, the thermosensitivity deteriorates seriously and the receiving layer yellows although the sticking problem is improved. It is believed that the reason for this is that a urethane bonding changes to an allophanate bonding in the reaction products by aging in such high temperature environment. In addition, a recording material used for a multiple recording method has lower thermosensitivity than a recording material used for a normal recording method because the ink layer has a higher softening point to prevent sticking and includes a larger amount of sublimable dye than the ink layer of the recording material for a normal recording method. Therefore, although these receiving materials are practical when used together with a recording material for a normal recording method, the receiving materials are not practical when used together with a recording material useful for a multiple recording method.

Japanese Laid-Open Patent Application No. 6-15966 discloses a receiving material whose ink layer includes a reaction product of polyoxyalkylenepolyol and an organic polyisocyanate. This reaction product has good resistance to sticking because it has a relatively high crosslinking density. However, this reaction product has relatively low thermosensitivity because a sublimation dye of a recording material can hardly diffuse into the reaction product. Accordingly, this receiving material is also not practical when used together with a recording material useful for multiple recording which has relatively low thermosensitivity.

Japanese Laid-Open Patent Application No. 7-314920 discloses a receiving material for a multiple recording method whose receiving layer includes a resin having an active hydrogen, an isocyanate compound and a catalyst which promotes the reaction of the resin and the isocyanate compound. This receiving material has good resistance to sticking and good thermosensitivity even when used together with a recording material useful for a multiple recording method. However, the receiving layer of the receiving material yellows by irradiation of light, and a recorded image fades with elapse of time when an aromatic isocyanate is used as an isocyanate compound. In addition, an adduct of hexamethylene diisocyanate which is used as an isocyanate compound in the patent application seriously deteriorates the thermosensitivity of the receiving material.

Japanese Laid-Open Patent Application No. 62-132680 discloses an image smoothing method in which an image recorded surface of a receiving material recorded by a normal recording method is subjected to a heat treatment to smooth the surface of the image. When recording an image on a receiving layer of a receiving material by a multiple recording method, the surface of the image is smooth without heat treatment. Therefore, the heat treatment to smooth the surface of the image has not been required in the multiple recording method.

Japanese Laid-Open Patent Application No. 4-153083 discloses an image treating method for multi-color recording in which an image recorded material is subjected to a heat treatment after each color image recording step. This heat treatment diffuses the dye image received on the surface of the receiving layer into the inside of the receiving layer. This prevents an ink layer of a recording material from contamination caused by unexpected dye re-transfer of the previously recorded color dye image onto the receiving layer of the receiving material. This heat treatment also prevents the recorded image from fading caused by the effects of light or oxygen in the air. However, this heat treatment makes the image recording speed slow, and further makes the color balance of the recorded image uneven because each color image is in a different diffused state in the receiving layer.

Japanese Laid-Open Patent Application No. 63-317386 discloses an image heat treating method in which a recorded image on a receiving layer is heated via a non-layered area formed on one part of an ink layer of a recording material. This heat treatment diffuses the dye image into the inside of the receiving layer and prevents the recorded image from fading caused by the effect of light and prevents goods or documents from contamination caused by unexpected dye re-transfer of the recorded image. However, a cost of the recording material increases because of the need to provide additional formation of the areas without a dye. Therefore the advantage of the multiple recording disappears.

Because of these reasons, a need exists for a receiving material for n-fold multiple recording which does not stick on a recording material in recording and has high thermosensitivity and good light resistant image qualities.

SUMMARY OF THE INVENTION

Accordingly, one object of the present invention is to provide a receiving material for multiple recording which does not stick on a recording material in recording and has high thermosensitivity and good light resistant image qualities.

To achieve such object of the present invention, the present invention is directed to a receiving material useful for sublimation thermal transfer recording, wherein the receiving layer includes a resin having activated hydrogen, an isocyanate compound and a catalyst promoting the crosslinking reaction of the resin and the isocyanate compound, a degree of gelation of the receiving layer is about 70 to 99% and the isocyanate compound includes one of a xylylene diisocyanate compound and an aliphatic isocyanate compound excepting an adduct of hexamethylene diisocyanate.

In an embodiment of the present invention, the isocyanate compound includes a derivative of one of xylylene diisocyanate, isophorone diisocyanate, and hydrogenated xylylene diisocyanate.

In another embodiment of the present invention, the isocyanate compound includes an adduct of xylylene diisocyanate.

In a yet another embodiment of the present invention, the isocyanate compound includes at least one of a monomer having a velocity constant or a secondary velocity constant in the reaction with 1-butanol of smaller than about $10^5$ and a derivative of the monomer.

In a further embodiment of the present invention, the isocyanate compound includes an adduct of hydrogenated xylylene diisocyanate.

In a still further embodiment of the present invention, the isocyanate compound includes an oxadiazinetrione derivative of hexamethylene diisocyanate.

In a still further embodiment of the present invention, the isocyanate compound includes one of an adduct of isophorone diisocyanate and a trimer of isophorone diisocyanate.

In a still further embodiment of the present invention, the catalyst is a tin-containing compound.

In a still further embodiment of the present invention, the resin having activated hydrogen is one of polyester and vinyl chloride-vinyl acetate copolymer.

In a still further embodiment of the present invention, the receiving layer further includes one of an antioxidant, a photostabilizer and an ultraviolet absorbing agent.

In a still further embodiment of the present invention, the photostabilizer is a compound which does not react with the isocyanate compound.

In a still further embodiment of the present invention, the receiving material includes one of paper, synthetic paper and a plastic film having a thickness of 0.1 to 3 mm.

In a still further embodiment of the present invention, a sublimation thermal transfer recording method is provided in which an image is formed on the receiving layer of the receiving material by n-fold multiple recording method.

In a still further embodiment of the present invention, the sublimation thermal transfer recording method includes a heat treatment step in which the image formed receiving layer is subjected to heat treatment.

In a still further embodiment of the present invention, a protective layer including an ultraviolet absorbing agent is further formed on the image formed receiving layer.

In a still further embodiment of the present invention, the protective layer is formed on an adhesive layer which is further formed on the image formed receiving layer and includes one of an ultraviolet absorbing agent, an antioxidant or a photostabilizer.

In a still further embodiment of the present invention, at least one of the protective layer and the adhesive layer which contacts the image on the receiving layer includes a resin having relatively low dye receivability.

In a still further embodiment of the present invention, the heat treatment is performed by at least one of a heat roller and ceramic heater.

These and other objects, features and advantages of the present invention will become apparent upon consideration of the following description of the preferred embodiments of the present invention.

DESCRIPTION OF THE PREFERRED EMBODIMENTS

The receiving material of the present invention can be recorded by a multiple recording method, resulting in reduction of a running recording cost.

Figure 1:
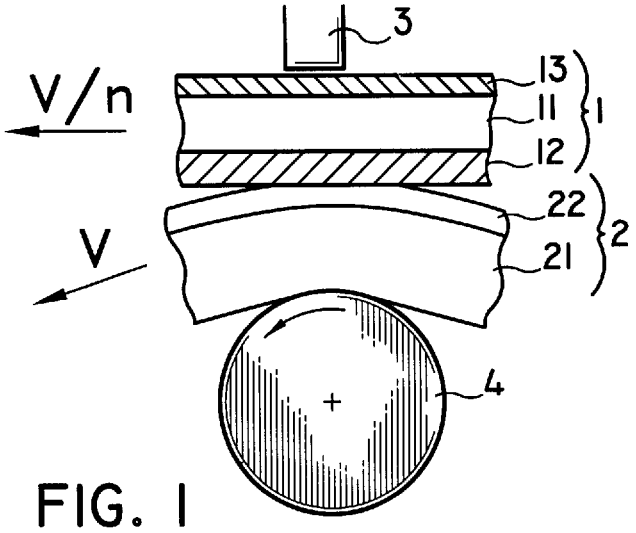
FIG. 1 is a front schematic view of a recording section using an n-fold multiple recording method of the present invention.

FIG. 1 is a front schematic view of a recording section for n-fold speed mode multiple recording which is useful for the receiving material of the present invention. In FIG. 1, reference numerals 1, 2, 3 and 4 designate a recording material, a receiving material, a thermal printhead and a platen roller, respectively. Reference numerals 11, 12 and 13 designate a substrate, an ink layer and a heat resistant layer, respectively, of a recording material 1. Reference numerals 21 and 22 designate a substrate and a receiving layer, respectively, of a receiving material 2.

Since the receiving layer 22 of the receiving material 2 of the present invention is a crosslinked resin which is a reaction product of a resin having activated hydrogen and an isocyanate compound, the receiving layer 22 has good heat resistance and good dye receivability. Further, since a catalyst promoting the crosslinking is included in the receiving layer 22, the resin of the receiving layer 22 has relatively high crosslinking density. Namely, there are few unreacted isocyanate groups in the resin, so that the degree of gelation of the receiving layer 22 reaches 70 to 99% in which the receiving layer 22 has good resistance to sticking on a recording material 1 and good thermosensitivity. Furthermore, since this receiving layer 22 can be easily obtained by heat treatment of relatively low temperature, the receiving layer 22 has good whiteness without coloring caused by high temperature heat treatment and the sheet of the receiving material 2 has good flatness without curling due to shrinkage of the receiving layer 22 which is also caused by high temperature heat treatment.

The degree of gelation in the present invention is measured and defined as follows:

(1) measuring the coating weight of the receiving layer 22 when the receiving layer 22 is formed, (2) cutting a sheet of the receiving material 2 50 mm wide and 100 mm long and measuring the weight of the sheet, (3) dipping the sheet into 500 g of methyl ethyl ketone or a good solvent for the resin of the receiving layer 22 for 10 min. to remove a solvent-soluble resin component in the receiving layer 22, (4) pulling up the sheet from the solvent and measuring the weight of the sheet after drying the solvent, and (5) obtaining the degree of gelation by the following equation; (degree of gelation)={(weight difference between the sheet before dipping and after dipping)/(weight of the receiving layer 22 of 50 mm wide and 100 mm long)}×100(%).

A suitable resin for use in the receiving layer 22 of the receiving material 2 of the present invention includes known resins which have activated hydrogen and can react with an isocyanate compound to form a crosslinked reaction product.

Specific examples of suitable resins include polyamide, polyethylene, polypropylene, acrylic resins, polyester, vinyl chloride-vinyl acetate copolymer, polycarbonate, polyurethane resins, epoxy resins, silicone resins, melamine resins, natural rubber, synthetic rubbers, polyvinyl alcohol, and cellulose resins. These resins can be employed individually or in combination. In addition, copolymers of these resins can also be employed.

Among these resins, polyester and vinyl chloride-vinyl acetate copolymer are preferable because these resins have good dye receivability and can easily produce a crosslinked resin having a proper degree of gelation by reaction with an isocyanate compound under the presence of a catalyst. Specific examples of polyesters include Vylon 200, Vylon 300, Vylon 500, GV-110, GV-230, UR-1200, UR-2300, EP-1012, EP-1032, DW-250H, DX-750H and DY-150H, which are manufactured by Toyobo Co., Ltd. Specific examples of vinyl chloride-vinyl acetate copolymers include VYHH, VYNS, VYHD, VYLF, VMCH, VMCC, VAGH and VROH, which are manufactured by Union Carbide Corp., and Denka Vinyl #1000A, 1000MT, 1000D, 1000L, 1000CK2 and 1000GKT, which are manufactured by Denki Kagaku Kogyo K.K.

Suitable isocyanate compounds for use in the receiving layer 22 of the receiving material 2 of the present invention include xylylene diisocyanate compounds and aliphatic isocyanate compounds excepting an adduct of hexamethylene diisocyanate.

As aforementioned, if an aromatic isocyanate is used as an isocyanate compound in a receiving layer 22, the receiving layer 22 tends to yellow when irradiated by light and the recorded image fades with elapse of time. Among aliphatic isocyanate compounds, an adduct of hexamethylene diisocyanate seriously deteriorates the thermosensitivity of the receiving material 2 when used in the receiving layer 22 and therefore would not be appropriate. Although xylylene diisocyanate is an aromatic isocyanate compound, xylylene diisocyanate has a methyl group between a benzene ring and an isocyanate group and therefore crosslinking is carried out easily and discoloring of the receiving layer 22 does not occur.

Specific examples of the isocyanate compounds include xylylene diisocyanate, hydrogenated xylylene diisocyanate, hydrogenated 4,4'-diphenylmethane diisocyanate, isophorone diisocyanate, tetramethyl xylylene diisocyanate, lysine diisocyanate, lysine ester triisocyanate, trans-1,4-cyclohexyldiisocyanate, 1,6,11-undecane triisocyanate, 1,8-diisocyanate-4-isocyanate methyloctane, bicycloheptane triisocyanate and derivatives of these compounds. (For the purpose of this invention, examples of derivatives of the compounds described herein include but are not limited to an adduct, a dimer and a trimer.) Among these isocyanate compounds, xylylene diisocyanate compounds such as adducts of xylylene diisocyanate, aliphatic diisocyanate compounds such as adducts of hydrogenated xylylene diisocyanate, adducts and trimers of isophorone diisocyanate, and oxadiazinetrione derivatives of hexamethylene diisocyanate are preferable. An isocyanate compound preferably includes at least one of a monomer having a velocity constant or a secondary velocity constant in the reaction with 1-butanol of smaller than about $10^5$ and a derivative of the monomer to prevent gelation of the coating liquid during coating. By using these isocyanate compounds together with a resin and a catalyst, a high crosslinked receiving layer 22 is easily manufactured without gelation of the coating liquid during coating and the formed receiving layer 22 has good resistance to sticking and light and good thermosensitivity in multiple recording. Specific examples of the preferable isocyanate compounds include Takenate D-110N, D-140N, D-120N and D-190N which are manufactured by Takeda Chemical Industries Inc.

An isocyanate compound and a resin are preferably mixed in a molar ratio of isocyanate groups included in the isocyanate compound to hydroxy groups included in the resin of 0.1/1 to 1/1 to form the receiving layer 22 having the above-mentioned desirable properties.

In formation of a receiving layer 22 of the present invention, it is preferable to age the receiving layer 22 after coating and to dry the receiving layer 22 so that the degree of gelation of the receiving layer 22 is 70 to 99%. The preferred aging temperature is 50° to 150° C., and more preferably 60° to 100° C. to prevent the receiving material 2 from coloring and curling.

A suitable catalyst for use in the receiving layer 22 of the receiving material 2 of the present invention includes an amine type catalyst such as, dimethylmethanolamine, diethylcyclohexylamine, triethylamine, N,N-dimethylpiperazine and triethylenediamine, and a metal containing catalyst such as, cobalt naphtenate, lead octenate, dibutyl tin dilaurate, stannous chloride, stannic chloride, tetra-n-butyl tin, tri-n-butyl tin acetate, dibutyl-n-butyl tin oxide. Among these catalysts, a tin-containing compound is preferable for this purpose. Specific examples of the tin-containing compound are TK1L which is manufactured by Takeda Chemical Industries Inc., or Scat1, Scat1L, Scat8, Scat10, Scat71L and StannBL, which are manufactured by Sankyo Organic Synthesis Co., Ltd. To obtain good heat resistance and good thermosensitivity, the preferred content of the catalyst in the receiving layer 22 is 0.05 to 1.3% by weight.

The receiving layer 22 of the receiving material 2 of the present invention preferably includes at least one of an antioxidant, a photostabilizer and an ultraviolet absorbing agent to prevent the receiving layer 22 and image formed thereon from coloring or fading. The preferred total content of an antioxidant, a photostabilizer and an ultraviolet absorbing agent is 0.005 to 30 parts by weight per 100 parts of total weight of resins in the receiving layer 22. If a protective layer including an ultraviolet absorbing agent which is mentioned later is formed on the receiving layer 22, an ultraviolet absorbing agent is not necessarily included in the receiving layer 22.

Specific examples of an antioxidant for use in the receiving layer 22 of the receiving material 2 the present invention include an amine type antioxidant such as, N,N'-diphenyl-1,4-phenylenediamine and phenyl-β-naphthylamine, a phenol type antioxidant such as, 2,6-di-t-butyl-β-cresol, 4,4'-butylidene-bis(3-methyl-6-butylphenol) and tetrakis{methylene-3-(3',5'-di-t-butyl-4'hydroxyphenyl)}propionate, a sulfur-containing antioxidant such as, 2-mercaptobenzothiazole and distearylthiodipropionate, hydroquinone type antioxidant such as, 2,5-di-t-butylhydroquinone, and guanidine derivatives such as, 1,3-dicyclohexyl-2-(2',5'-dichlorophenyl)guanidine.

Suitable photostabilizers for use in the receiving layer 22 of the receiving material 2 of the present invention include hindered amines and hindered phenols. Tertiary amine type photostabilizers are preferable because they do not react with an isocyanate compound used for the receiving layer 22. Specific examples of the tertiary amine type photostabilizer are Adekastab LA-82, Adekaarcles DN-44M which are manufactured by Asahi Denka Kogyo K.K. and Sanol LS-765 which is manufactured by Sankyo Co., Ltd.

Suitable ultraviolet absorbing agents for use in the receiving layer 22 of the receiving material 2 of the present invention include known ultraviolet absorbing agents such as, hydroxybenzophenone, dihydroxybenzophenone, benzotriazole, hindered amine and salicylate derivatives. Specific examples of the ultraviolet absorbing agents include Tinuvin P (manufactured by Ciba Geigy Ltd.), 2-hydroxy-4-methoxybenzophenone, 2-hydroxy-4-octoxybenzophenone, 2-(2'-hydroxy-3',5'-di-t-butylphenyl)-5-chlorobenzotriazole and 2-(2'-hydroxy-3'-t-butyl-5'-methylphenyl)-5-chlorobenzotriazole.

The receiving material 2 of the present invention preferably includes a protective layer.

Figure 2A:
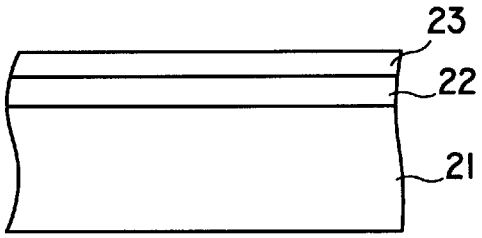
FIG. 2*a* is a sectional view of a receiving material which is superimposed with a protective layer in the present invention.

FIG. 2*a* is a sectional view of a receiving material 2 which is superimposed with a protective layer. Reference numeral 23 represents a protective layer.

Figure 2B:
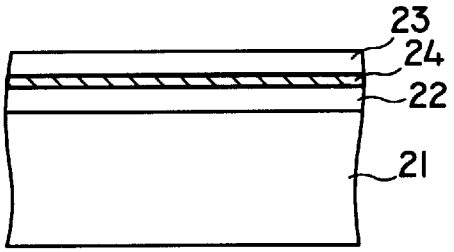
FIG. 2*b* is a sectional view of a receiving material which is superimposed with a protective layer via an adhesive layer in the present invention.

FIG. 2*b* is a sectional view of a receiving material 2 which is superimposed with a protective layer 23 via an adhesive layer. Reference numeral 24 represents an adhesive layer.

The protective layer 23 is formed on an image formed receiving layer 22 to prevent the recorded image and the receiving layer 22 from fading or coloring. The protective layer 23 preferably includes an ultraviolet absorbing agent.

The protective layer 23 is preferably formed, for example, by one of the following methods:

(1) a plastic film which includes an ultraviolet absorbing agent and, if desired, a layer of metal coated thereon by evaporation, is superimposed on the image formed receiving layer 22 via an adhesive agent which is thermosensitive or pressure sensitive;

(2) a transferable protective layer 23 which is formed on a temporary substrate, including an ultraviolet absorbing agent, and, if desired, has an adhesive layer 24 thereon which is thermosensitive or pressure sensitive, is transferred onto the image formed receiving layer 22;

(3) a transferable protective layer 23 which is formed on a temporary substrate via a releasing layer and includes an ultraviolet absorbing agent is transferred onto the image formed receiving layer 22; or (4) a transferable protective layer 23 which is repeatedly formed on an area of an ink layer 12 of a recording material 1 and includes an ultraviolet absorbing agent is transferred onto the image formed receiving layer 22 by heating from the backside, i.e., the heat resistant layer 13 side, of the recording material 1.

The protective layer 23 is preferably formed on the image formed receiving layer 22 before or after a heat treatment to the image formed receiving layer 22. The protective layer 23 which is formed by the above-mentioned method (4) is preferably formed on the image formed receiving layer 22 while the receiving layer 22 is being subjected to heat treatment.

The plastic film useful for the protective layer 23 of the present invention includes known plastic films which have good resistance to abrasion and chemicals, good transparency and hardness.

Specific examples of the plastic film include polyester, polypropylene, cellophane, polycarbonate, cellulose acetate, polyethylene, polyvinyl acetate, polystyrene, polyamide, aromatic polyamide, polyimide, polysulfone, polyvinylidene chloride, polyvinyl alcohol and fluorine-containing resins. Among these films, a polyethylene terephthalate (PET) film having a thickness of 5 to 50 μm is preferable because of having relatively good heat resistance and small heat shrinkage.

Materials useful for the transferable protective layer 23 of the present invention include resins which have good transparency, do not adhere to the temporary substrate when heated, and are preferably crosslinkable.

Specific examples of the resins include crosslinkable polyurethane resins, crosslinkable polyester resins, acetate resins, silicone resins which are modified by polyester, polystyrene, acrylate and urethane, and resins having relatively low dye receivability which are mentioned later. The resin having relatively low dye receivability of 0.1 to 50 μm thick is preferable to prevent blur of the formed image.

The adhesive layer 24 which is thermosensitive or pressure sensitive adheres the film of the protective layer 23 to the image formed receiving layer 22. Specific examples of the adhesive agents include acrylic resins, polyvinyl chloride resins, vinyl chloride-vinyl acetate resins, polyester resins, polyamide resins, ethylene-acrylate copolymers, ethylene-vinyl acetate resins, polyurethane resins, polymethylmethacrylate and silicone resins which are not modified or are modified by such as, polyester, polystyrene, acrylate and urethane. Among these resins, a resin having relatively low dye receivability which are mentioned later is preferable for the adhesive agent to prevent blur of the recorded image. The preferred thickness of the adhesive layer is 0.1 to 10 μm.

In addition, the adhesive layer 24 preferably includes at least one of an antioxidant, a photostabilizer and an ultraviolet absorbing agent and more preferably includes all of these materials. If a protective layer 23 including an ultraviolet absorbing agent is formed, the adhesive layer 24 necessarily includes an ultraviolet absorbing agent.

Dye receivability of a resin is measured as follows:

(1) preparing a coating liquid by mixing a resin solution having a solid content of 5 to 20% by weight and a silicone oil which is a mixture of SF8417 and SF8411 (both of which are manufactured by Toray Silicone Industries Inc.) of a mixing ratio of 1/1 so that the ratio of the silicone oil to the solid of the resin is 0.3;

(2) coating the coating liquid on a sheet of synthetic paper, Yupo FPG#95 manufactured by Oji Yuka Synthetic Paper Co., Ltd., and drying the coated liquid for 1 min. to form a receiving layer 22 so that the layer thickness is 10 μm on a dry basis;

(3) aging the coated receiving material 2 at room temperature for more than 1 day;

(4) superimposing a cyan colored recording material 1, e.g., Ck2LB used for Mitsubishi Color Video Copy Processor, on the receiving layer 22 and record an image on the receiving material 2 by image-wise heating from the backside of the recording material 1 using a thermal printhead 3, e.g., KMT-85-6MPD4 (manufactured by Kyocera Corp.) having a dot density of 6 dots/mm and an average electric resistance of 542 Å, under a condition of applied energy of 2.00 mJ/dot; and (5) measuring the image density of the recorded image with a Macbeth reflective densitometer RD-918.

The resin whose image density is lower than 1.2 is defined as a resin having relatively low dye receivability in the present invention.

The resin whose image density is lower than 1.0 is preferable for use in the protective layer 23 and the adhesive layer 24 of the present invention.

Specific examples of the resin having relatively low dye receivability include aromatic polyester resins, styrene-butadiene copolymers, polyvinyl acetate resins, polyamides, polymethylmethacrylate and copolymers thereof, styrene-maleic acid ester copolymers, polyimides, acetate resins, silicone resins, styrene-acrylonitrile copolymers, polysulfone and polyvinyl alcohol. Among these resins, polymethylmethacrylate and copolymers thereof, styrene-maleic acid ester copolymers, polyimides, acetate resins, silicone resins, styrene-acrylonitrile copolymers, polysulfone and polyvinyl alcohol are particularly preferable.

The recording method of the present invention uses n-fold speed mode multiple recording in which a feeding speed ratio (n) or a ratio of feeding length per unit time (n) of the receiving material 2 to the recording material 1 is greater than 1, resulting in reduction of the running recording cost.

In multiple recording, since the recording material 1 and the receiving material 2 are run at different speeds during recording, a strong friction force occurs between the recording material 1 and the receiving material 2, so that the two materials tend to stick to each other or are otherwise damaged. Therefore, the surface of the receiving layer 22 is preferably lubricated. That is, lubricants are preferably included in the receiving layer 22 to make the receiving layer 22 lubricating.

Specific examples of the lubricants are as follows: petroleum lubricants such as liquid paraffin, synthetic lubricants such as, carbon chloride, diester oil, silicone oil fluorine-containing silicone oil, modified silicone oil which is modified by, for example, epoxy, amino, alkyl and polyether group, lubricating products such as a copolymer of silicone and an organic compound such as polyoxyalkyleneglycol, fluorine-containing lubricants such as fluoroalkyl compounds, wax such as paraffin wax and polyethylene wax, higher fatty acids, higher aliphatic alcohols, higher fatty acid amides, higher fatty acid esters and higher fatty acid salts. The preferable content of the lubricant in the receiving layer 22 is about 5 to 30% by weight.

The substrate 21 for use in the receiving material 2 of the present invention includes paper, synthetic paper, a plastic film and a thick plastic film for a substrate 21. Specific examples of the substrate 21 include polyester, polypropylene, cellophane, polycarbonate, cellulose acetate, polyethylene, polyvinyl acetate, polystyrene, polyamide, aromatic polyamide, polyimide, polysulfone, polyvinylidene chloride, polyvinyl alcohol and fluorine-containing resin. Among these materials, polyethylene terephthalate (PET) whose thickness is 0.1 to 3 mm is preferable because it has relatively good heat resistance and small heat shrinkage.

The receiving material 2 of the present invention is preferably manufactured by, for example, the following methods:

(1) a receiving layer 22 is formed by, for example, one of the following methods;

(A) a receiving layer 22 is coated on a substrate 21 and dried to form a receiving material 2, (B) an intermediate layer such as an adhesive layer is formed on a substrate 21 and a receiving layer 22 is coated thereon and dried to form a receiving material 2, (C) a heat insulating layer is formed on a substrate 21 and a receiving layer 22 is coated thereon and dried to form a receiving material 2, or (D) a film layer having elasticity such as, foamed polypropylene, foamed polyester or synthetic paper, is formed on a substrate 21 and a receiving layer 22 is coated thereon and dried to form a receiving material 2, and (2) the prepared receiving materials 2 are aged at a high temperature atmosphere or are subjected to a heat treatment to crosslink the receiving layer 22.

The preferable thickness of the receiving layer 22 is 1 to 20 μm.

A preferable recording material 1 for use in combination with the receiving material 2 of the present invention includes a substrate 11 and an ink layer 12 including sublimable dye and a binder.

As the substrate 11 for use in the recording material 1 of the present invention, any known substrate for use in the conventional sublimation thermal transfer recording material can be employed. For example, a condenser paper and plastic film, such as polyester, polyethylene naphthalate, polystyrene, polysulfone, polyimide, polyvinyl alcohol, cellophane and aromatic polyamide which have a thickness of 2 to 50 μm are preferably employed.

The sublimable dye for use in the present invention includes a sublimable disperse dye, an oil-soluble dye and a basic dye which sublimates at a temperature more than about 60° C.

Specific examples of sublimable dye are as follows:

C.I. Disperse Yellows 1, 3, 8, 9, 16, 41, 54, 60, 77 and 116;

C.I. Disperse Reds 1, 4, 6, 11, 15, 17, 55, 59, 60, 73 and 83;

C.I. Disperse Blues 3, 14, 19, 26, 56, 60, 64, 72, 99 and 108;

C.I. Solvent Yellows 77 and 116;

C.I. Solvent Reds 23, 25 and 27; and

C.I. Solvent Blues 36, 63, 83 and 105.

These sublimable dyes are employed individually or in combination.

The binder for use in the ink layer 12 includes a thermoplastic resin or thermosetting resin such as polyvinyl chloride resins, polyvinyl acetate resins, polyamides, polyethylene, polycarbonate, polystyrene, polypropylene, acrylic resins, phenolic resins, polyester, polyurethane, epoxy resins, silicone resins, fluorine-containing resins, butyral resins, melamine resins, natural rubber, synthetic rubber, polyvinyl alcohol and cellulose resins.

The thickness of the ink layer 12 is preferably 0.5 to 20 μm, and more preferably 1 to 10 μm to maintain good thermosensitivity. The content of the sublimable dye in the ink layer 12 is preferably 5 to 80%, and more preferably 50 to 80% to maintain good thermosensitivity and preservability.

Figure 3:
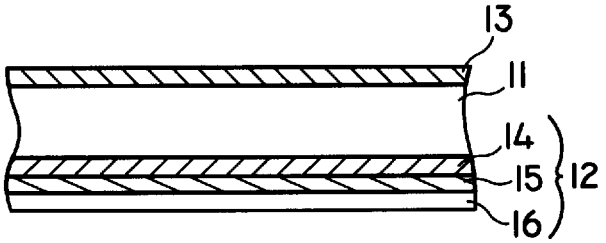
FIG. 3 is a sectional view of a recording material useful for n-fold multiple recording method of the present invention.

A preferable composition of ink layer 12 of the recording material 1 for use in n-fold speed mode multiple recording is shown in FIG. 3. Ink layer 12 includes a dye supplying layer 14, a dye transferring layer 15 formed thereon and a resin layer 16 having relatively low dye receivability formed further thereon, wherein at least the dye supplying layer 14 includes an undissolved sublimable dye particle to maintain good recording qualities by continuously supplying sublimable dye to the receiving material 2 during image recording. The undissolved particle means a particle shaped sublimable dye which is separated during a drying step from a coated dye supplying layer coating liquid including a binder, a sublimable dye and solvent. Therefore, the amount of the separated dye particle changes depending on the used solvent.

Presence of a particle shaped sublimable dye in a coated dye supplying layer 14 is easily observed by an electron microscope.

The preferable particle size of the particle shaped sublimable dye which depends on the thickness of the dye supplying layer 14 is 0.01 to 20 μm, and more preferably 1.0 to 5 μm.

The dye transferability of the dye supplying layer 14 is preferably greater than that of the dye transferring layer 15. Comparison of dye transferability is carried out by the following method:

(1) each of a dye supplying layer coating liquid and a dye transferring layer coating liquid are coated on a respective substrate 11, and dried to form a recording material 1;

(2) each of the prepared recording materials 1 is superimposed on a respective receiving material 2 so that the coated surface faces the receiving layer 22, and heat is applied from the backside of each recording material 1 to record an image; and (3) image density of each recorded image is measured. The recording material 1 having a higher image density has higher dye transferability.

According to our investigation, the quantity of diffused dye in an ink layer 12 can be represented by the following Fick's law;

$$dn=-D\cdot(dc/dx)\cdot q\cdot dt$$

wherein dn represents a quantity of the diffused dye for a time of dt, q represents a cross section into which the dye diffuses, dc/dx represents a gradient of the diffused dye concentration, and D represents an average diffusion coefficient in the ink layer 12 when heat is applied.

As being understandable from the above-mentioned equation, the ways of effectively supplying dye from a dye supplying layer 14 to a dye transferring layer 15 are as follows:

(1) the concentration of dye included in the dye supplying layer 14 should be higher than that in the dye transferring layer 15; and/or (2) the diffusion coefficient of the dye supplying layer 14 should be greater than that of the dye transferring layer 15.

The thickness of the dye transferring layer 15 and the resin layer 16 having relatively low dye receivability are each preferably 0.05 to 5 μm, and more preferably 0.1 to 2 μm. The thickness of the dye supplying layer 14 is preferably 0.1 to 20 μm, and more preferably 0.5 to 10 μm.

Suitable binder resins and sublimable dyes in the dye supplying layer 14 and dye transferring layer 15 include known resins and sublimable dyes.

The glass transition temperature and softening point of the dye supplying layer 14 are preferably lower than that of the dye transferring layer 15 to effectively supply a sublimable dye to the dye transferring layer 15. A resin whose glass transition temperature is below 0° C. or whose softening point is lower than 60° C. is preferably employed in the dye supplying layer 14.

Specific examples of resins having relatively low glass transition temperatures or softening points include natural rubbers and synthetic rubbers. Among these rubbers, polyethylene oxide (for example, Alcocks E-30, E-45, R-150, R-400 and R-1000 manufactured by Meisei Chemical Works, Ltd.) and caprolactone polyol (for example, Praccel H-1, H-4 and H-7 manufactured by Daicel Chemical Industries, Ltd.) are preferable. It is preferable to mix one or more of these rubbers and one or more of the aforementioned thermoplastics or thermosetting resins of the binder in a case of forming the dye supplying layer.

The dye concentration of the dye transferring layer 15 and the resin layer 16 having relatively low dye receivability is 0 to 80% by weight, and preferably 10 to 60% by weight. The dye concentration of the dye supplying layer 14 is preferably 5 to 80% by weight. The ratio of the dye concentration of the dye supplying layer 14 to that of the dye transferring layer 15 is 1.1 to 5, and preferably 1.5 to 3.

The sublimable dye is preferably dispersed in a molecular state in the dye transferring layer 15 and the resin layer 16 having relatively low dye receivability to record an image having good evenness.

These three layers may include auxiliary agents such as, lubricants, crosslinking agents, dispersants and antioxidants.

Suitable materials which may be employed as a substrate 11 in the recording material 1 of the present invention include heat resistant films such as, condenser paper, polyester film, polystyrene film, polysulfone film, polyimide film and polyaramid film. An adhesive layer may be formed between the substrate 11 and the dye supplying layer 14 and a heat resistant layer 13 may be formed on the non-layered side of the substrate 11 of the recording material 1 of the present invention.

Up to this point, there has been described a recording material 1 having a three-layer ink layer 12. However, an ink layer 12 having four or more layers, each of which have different functions, may be available.

The recording method of the present invention includes the following steps:

(1) superimposing the recording material 1 on the receiving material 2 so that the ink layer 12 of the recording material 1 faces the receiving layer 22 of the receiving material 2;

(2) heating image-wise the back side, i.e., the heat resistant layer 13 side, of the recording material 1 by, for example, a thermal printhead 3 to form an image on the receiving layer 22 while the receiving material 2 is fed at a speed n-times faster than the recording material 1, which is n-fold speed mode multiple recording; and (3) subjecting the image formed receiving layer 22 to a heat treatment which diffuses the recorded image into the receiving layer 22 to prevent the oxidation of the sublimated dye image, resulting in improvement of the light resistance of the recorded image.

In general, the temperature of the heat treatment, which depends on the heating time, is 60° to 250° C., and preferably 80° to 200° C. to maintain good image quality without blurring and good flatness of the image recorded sheet without curling. The heating time of the heat treatment is 0.1 to 30 sec., and preferably 0.1 to 5 sec. to maintain the above-mentioned qualities.

Since the receiving material 2 useful for multiple recording has good heat resistance, the temperature of the heat treatment is preferably 150° to 200° C. to effectively diffuse the recorded dye image into the receiving layer 22. As the heating method, it is preferable that the receiving material 2 be subjected to the heat treatment while being fed at 1.0 to 25 mm/sec. and preferably 5 to 15 mm/sec.

The heat treatment is performed before, after or during the time of formation of the protective layer 23, depending on the usage of the image recorded receiving material 2 and the structure of the recording apparatus.

Suitable heating devices useful for the heat treatment include known heating devices. Among these heating devices, a thermal printhead is preferable because of having rapid temperature rising properties if desired to heat for recording an image. If the receiving layer 22 of the receiving material 2 is a crosslinkable receiving layer 22, a roll heater or a ceramic heater such as an alumina ceramic heater is preferable because of having greater heating abilities than the thermal printhead.

If a problem such as curling of the receiving material 2 occurs upon application of the heat treatment, the substrate 21 of the receiving material 2 should be formed of a relatively thick material such as a substrate for cards. Suitable substrates useful for cards in the present invention include known plastic films such as, polyester resin film and polyvinyl chloride resin film, or metal films, all of which are preferably coated with a receiving layer 22 thereon. These substrates may have an IC memory circuit, magnetic layer or other print layer in addition to the receiving layer 22.

Up to this point, there has been described the recording method using a thermal printhead 3 as a heating device. However, other printing methods using heating devices such as a heating plate and laser, or using Joule heat effect generated in a recording material are also suitable. Suitable recording methods using Joule heat effect include an electrosensitive thermal transfer recording method which is disclosed, for example, in U.S. Pat. No. 4,103,066 and Japanese Laid-Open Patent Applications No. 57-14060, 57-11080 and 59-9096.

The electrosensitive thermal transfer recording material useful for the electrosensitive thermal transfer recording method in the present invention is manufactured by, for example, the following methods:

(1) coating a semiconductive layer on a substrate which includes a heat resistant resin such as, polyester, polycarbonate, triacetyl cellulose, nylon, polyimide and aromatic polyamide, and a metal powder such as, aluminum, copper, iron, tin, nickel, molybdenum and silver which is dispersed in the heat resistant resin, and forming an ink layer including sublimable dye on the semiconductive layer; or (2) forming a semiconductive layer including an above-mentioned metal powder described step in (1) on a substrate by an evaporation or sputtering method and forming an ink layer including sublimable dye on the semiconductive layer.

The thickness of the substrate is preferably 2 to 15 $\mu$m in consideration of the heat conductive efficiency.

When laser is used for the heating device of the recording method, a recording material including a substrate which absorbs laser to generate heat is employed. For example, a recording material having a substrate including carbon or having a laser absorbing layer which is formed on at least one side of the substrate is preferably employed.

Having generally described this invention, a further understanding can be obtained by reference to certain specific examples which are provided herein for purposes of illustration only and are not intended to be limiting. In the descriptions in the following examples, numbers are weight ratios unless otherwise specified.

EXAMPLES

Example 1

1-1. Preparation of receiving material

The following receiving layer coating liquid was prepared, coated on a foamed PET film, W900E manufactured by Diafoil Corp., and dried. The coated film was subjected to a heat treatment at 60° C. for 50 hrs. to prepare a receiving material having a receiving layer 6 $\mu$m thick.

Formulation of receiving layer coating liquid:

polyester resin (Vylon 200 manufactured by Toyobo Co., Ltd.) 15 adduct of xylylene diisocyanate (Takenate D-110N, manufactured by Takeda Chemical Industries, Ltd.) 5 catalyst including tin (Takenate TK-1L, manufactured by Takeda Chemical Industries, Ltd.) 0.1 unmodified silicone oil (SH200 having kinematic viscosity of 1000 cs, manufactured by Toray Silicone Industries, Inc.) 0.5 alcohol modified silicone oil (SF8427, manufactured by Toray Silicone Industries, Inc.) 0.5 toluene 40 methyl ethyl ketone 40

1-2. Preparation of recording material

An intermediate adhesive layer coating liquid was applied with a wire bar on a non-layered surface of an aromatic polyamide film of 6 μm in thickness having a heat resistant layer 1 μm thick including a silicone resin, dried at 100° C. for 90 sec. and aged at 60° C. for 12 hrs. to form an intermediate adhesive layer. Then a dye supplying layer was coated on the intermediate layer in a thickness of 4.5 μm on a dry basis, further thereon a dye transferring layer was coated in a thickness of 0.5 μm on a dry basis and still further thereon a resin layer having relatively low dye receivability was coated in a thickness of 0.7 μm on a dry basis. The coated layer was dried at 100° C. for 90 sec. and aged at 60° C. for 12 hrs. after each of the coatings. Thus a recording material was obtained.

Formulation of intermediate adhesive layer coating liquid:

polyvinyl butyral resin (BX-1, manufactured by Sekisui Chemical Co.) 10 isocyanate compound (Colonate L, manufactured by Nippon Polyurethane Industry Co., Ltd.) 5 toluene 95 methyl ethyl ketone 95

Formulation of dye supplying layer coating liquid:

polyvinyl butyral resin (BX-1, manufactured by Sekisui Chemical Co.) 10 isocyanate compound (Colonate L, manufactured by Nippon Polyurethane Industry Co., Ltd.) 5 sublimable dye (R-3, manufactured by Nippon Kayaku Co., Ltd.) 30 ethanol 180 n-butanol 10

Formulation of dye transferring layer coating liquid:

polyvinyl butyral resin (BX-1, manufactured by Sekisui Chemical Co.) 10 isocyanate compound (Colonate L, manufactured by Nippon Polyurethane Industry Co., Ltd.) 5 sublimable dye (R-3, manufactured by Nippon Kayaku Co., Ltd.) 5 toluene 95 methyl ethyl ketone 95

Formulation of coating liquid of resin layer having relatively low dye receivability:

styrene-maleic acid copolymer (Suprapal AP-30, manufactured by BASF Ltd.) 5 liquid A 20 n-butanol 20

The liquid A was prepared by dissolving 15 g of dimethyl methoxy silane and 9 g of methyl trimethoxy silane in a mixture of 12 g of toluene and 12 g of methyl ethyl ketone, and hydrolyzing for 3 hrs. with addition of 13 ml of 3% sulfuric acid.

1-3. Recording method

The recording material was superimposed on the receiving material so that the resin layer having relatively low dye receivability of the recording material contacts the receiving layer of the receiving material. Heat was then applied with a thermal printhead from the heat resistant layer side thereof to form an image on the receiving layer of the receiving material.

The recording conditions are as follows:

dot density of the thermal printhead 12 dots/mm applied electric power 0.16 W/dot feeding speed of the receiving material 8.4 mm/sec.

feeding speed of the recording material 0.6 mm/sec.

Thus an image formed receiving material was obtained.

Example 2

The procedure for preparation of the receiving material in Example 1 was repeated except that the polyester resin was replaced by vinyl chloride-vinyl acetate-vinyl alcohol copolymer (VAGH, manufactured by Union Carbide Corp.).

The procedure for recording the image in Example 1 was also repeated. Thus an image formed receiving material was obtained.

Example 3

The procedure for preparation of the receiving material in Example 2 was repeated except that the adduct of xylylene diisocyanate was replaced by an adduct of hydrogenated xylylene diisocyanate (Takenate D-120N, manufactured by Takeda Chemical Industries, Ltd.).

The procedure for recording the image in Example 1 was also repeated. Thus an image formed receiving material was obtained.

Example 4

The procedure for preparation of the receiving material in Example 2 was repeated except that the adduct of xylylene diisocyanate was replaced by oxadiazinetrione derivative of hexamethylene diisocyanate (Takenate D-190N, manufactured by Takeda Chemical Industries, Ltd.).

The procedure for recording the image in Example 1 was also repeated. Thus an image formed receiving material was obtained.

Example 5

The procedure for preparation of the receiving material in Example 2 was repeated except that the adduct of xylylene diisocyanate was replaced by an adduct of isophorone diisocyanate (Takenate D-140N, manufactured by Takeda Chemical Industries, Ltd.).

The procedure for recording the image in Example 1 was also repeated. Thus an image formed receiving material was obtained.

Example 6

The procedure for preparation of the receiving material in Example 2 was repeated except that the adduct of xylylene diisocyanate was replaced by a trimer of isophorone diisocyanate (Desmodule Z-4370, manufactured by Bayer Ltd.).

The procedure for recording the image in Example 1 was also repeated. Thus an image formed receiving material was obtained.

Example 7

The procedure for preparation of the receiving material in Example 2 was repeated except that a hindered amine type photostabilizer (Sanol LS-765, manufactured by Sankyo Co.) was added to the receiving layer coating liquid in an amount of 0.5 parts by weight.

The procedure for recording the image in Example 1 was also repeated. Thus an image formed receiving material was obtained.

Example 8

The image formed receiving material obtained in Example 5 was overlaid with a PET film including an ultraviolet absorbing agent (HB-50, manufactured by Dow Corning Toray Silicone Co., Ltd.) using a silicone type adhesive agent (SD4580, manufactured by Dow Corning Toray Silicone Co., Ltd.).

Thus an image formed receiving material having a protective layer was obtained.

Example 9

The image formed receiving material obtained in Example 5 was subjected to a heat treatment at 90° C. for 10 sec. under pressure of 10 g/cm$^2$.

Thus an image formed receiving material subjected to a heat treatment was obtained.

Example 10

The image formed receiving material obtained in Example 5 was overlaid with a PET film including an ultraviolet absorbing agent (HB-50, manufactured by Dow Corning Toray Silicone Co., Ltd.) using an acrylic adhesive agent (Olybine BPS4627-6, manufactured by Toyo Ink Mfg. Co., Ltd.) and subjected to a heat treatment at 90° C. for 10 sec. under pressure of 10 g/cm$^2$.

Thus an image formed receiving material which had a protective layer and was subjected to a heat treatment was obtained.

Example 11

The image formed receiving material subjected to a heat treatment obtained in Example 9 was overlaid with a PET film including an ultraviolet absorbing agent (HB-50, manufactured by Dow Corning Toray Silicone Co., Ltd.) using a silicone type adhesive agent (SD4580, manufactured by Dow Corning Toray Silicone Co., Ltd.).

Thus an image formed receiving material which had a protective layer and was subjected to a heat treatment was obtained.

Example 12

The image formed receiving material subjected to a heat treatment obtained in Example 9 was overlaid with a PET film including an ultraviolet absorbing agent (HB-50, manufactured by Dow Corning Toray Silicone Co., Ltd.) using an ultraviolet absorbing agent (SANDVOR VSU, manufactured by Sandoz Ltd.).

Thus an image formed receiving material which had a protective layer and was subjected to a heat treatment was obtained.

Example 13

The image formed receiving material obtained in Example 5 was overlaid with a PET film including an ultraviolet absorbing agent (HB-50, manufactured by Dow Corning Toray Silicone Co., Ltd.) using an acrylic adhesive agent (Olybine BPS4627-6, manufactured by Toyo Ink Mfg. Co., Ltd.) while being subjected to a heat treatment at 90° C. for 10 sec. under pressure of 10 g/cm$^2$.

Thus an image formed receiving material which had a protective layer and was subjected to a heat treatment was obtained.

Example 14

The image formed receiving material subjected to a heat treatment was overlaid with a white polyethyleneterephthalate (PET) film 750 $\mu$m thick using an acrylic adhesive agent (Olybine BPS4627-6, manufactured by Toyo Ink Mfg. Co., Ltd.) so that the non-layered side of the receiving material faces the white PET.

Thus an image formed receiving material which had a thick substrate and was subjected to a heat treatment was obtained.

Example 15

The procedure for preparation of the image formed receiving material which had a protective layer and was subjected to a heat treatment in Example 9 was repeated except that the heat treatment was performed by a heat roller at a temperature of 190° C. and heat treating speed of 1.5 mm/sec.

Thus an image formed receiving material which had a protective layer and was subjected to a heat treatment was obtained.

Example 16

The procedure for preparation of the image formed receiving material which had a protective layer and was subjected to a heat treatment in Example 9 was repeated except that the heat treatment was performed by a alumina ceramic heater (manufactured by Kyocera Corp.)at a temperature of 190° C. and a heat treating speed of 1.5 mm/sec.

Thus an image formed receiving material which had a protective layer and was subjected to a heat treatment was obtained.

Comparative Example 1

The procedure for preparation of the receiving material in Example 2 was repeated except that the adduct of xylylene diisocyanate was replaced by an adduct of tolylene diisocyanate (Colonate L, manufactured by Nippon Polyurethane Industry, Co., Ltd.).

The procedure for recording the image in Example 1 was also repeated. Thus an image formed receiving material was obtained.

Comparative Example 2

The procedure for preparation of the receiving material in Example 2 was repeated except that the adduct of xylylene diisocyanate was replaced by an adduct of hexamethylene diisocyanate (Takenate D-160N, manufactured by Takeda Chemical Industries, Ltd.).

The procedure for recording the image in Example 1 was also repeated. Thus an image formed receiving material was obtained.

Comparative Example 3

The following receiving layer coating liquid was prepared, coated on a foamed polyethyleneterephthalate (PET) film, W900E manufactured by Diafoil Corp., and dried. The coated film was subjected to a heat treatment at 120° C. for 30 min. to prepare a receiving material having a receiving layer 6 $\mu$m thick. Formulation of receiving layer coating liquid:

vinyl chloride-vinyl acetate-vinyl alcohol (VAGH, manufactured by Union Carbide Corp.) 15 trimer of hexamethylene diisocyanate (Colonate HK, manufactured by Nippon Polyurethane Industry, Co., Ltd.) 6 dibutyl tin dilaurate 0.1 unmodified silicone oil (SH200 having kinematic viscosity of 1000 cs, manufactured by Toray Silicone Industries, Inc.) 0.5 alcohol modified silicone oil (SF8427, manufactured by Toray Silicone Industries, Inc.) 0.5 toluene 40 methyl ethyl ketone 40

The following items were evaluated for the receiving materials:

(1) Degree of gelation of receiving layer

Degree of gelation of the receiving layer of each receiving material was measured by the aforementioned method.

(2) Sticking of receiving layer on recording material

It was observed whether each receiving material stuck to the recording material during recording. The results of the sticking were classified as follows:

×: sticking badly occurred

Δ: sticking slightly occurred, however was acceptable

○: sticking hardly occurred

◎: sticking did not occur (3) Thermosensitivity

Thermosensitivity is defined as the image density of the recorded image of each receiving material.

(4) Pot life of receiving layer coating liquid

Pot life of each receiving layer coating liquid was defined as the gelation time from the end of the preparation to the generation of the gelation of the receiving layer coating liquid. The gelation time was classified as follows:

×: within 1 hr.

Δ: from 1 to 12 hrs.

○: greater than 12 hrs.

(5) Resistance to light of recorded image

A recorded image on each receiving material having an image density of about 1.0 measured by Macbeth reflection densitometer RD918, was exposed to light for 24 hrs. using a Xenon weathering tester manufactured by Shimazu Corp. The image density of the light received image was measured. The resistance to light is defined as a remaining rate of image density which is represented by the following equation:

remaining rate of image density (%)={(image density of light received image)/(image density before test)}×100

The thermosensitivity and resistance to light of each receiving material having an image recorded with a recording material in which the sublimable dye, R-3, was replaced by Y-2 manufactured by Nippon Kayaku Co. Ltd. were also measured.

The results are shown in Table 1.

TABLE 1

| | degree of gelation (%) | sticking | thermosensitivity R-3/Y-2 | pot life (hour) | remaining image density (%) R-3/Y-2 | notes |
|---|---|---|---|---|---|---|
| Example 1 | 90 | Δ | 1.9/1.9 | Δ | 25/20 | slightly sticks |
| Example 2 | 98 | ○ | 1.9/1.9 | x | 29/23 | |
| Example 3 | 98 | ○ | 2.0/2.1 | Δ | 31/25 | |
| Example 4 | 97 | ○ | 2.2/2.1 | Δ | 35/23 | |
| Example 5 | 95 | ○ | 2.4/2.4 | ○ | 32/23 | |
| Example 6 | 94 | ○ | 2.3/2.2 | ○ | 31/22 | |

TABLE 1-continued

| | degree of gelation (%) | sticking | thermosensitivity R-3/Y-2 | pot life (hour) | remaining image density (%) R-3/Y-2 | notes |
|---|---|---|---|---|---|---|
| Example 7 | 98 | ○ | 1.9/1.9 | x | 35/25 | |
| Example 8 | — | — | — | — | 65/60 | |
| Example 9 | — | — | — | — | 73/65 | |
| Example 10 | — | — | — | — | 90/85 | *1 |
| Example 11 | — | — | — | — | 85/80 | |
| Example 12 | — | — | — | — | 87/83 | |
| Example 13 | — | — | — | — | 90/85 | *1 |
| Example 14 | — | — | — | — | 73/65 | good curling property |
| Example 15 | — | — | — | — | 90/85 | |
| Example 16 | — | — | — | — | 90/85 | |
| Comparative Example 1 | 98 | ○ | 2.2/2.1 | Δ | 11/8 | poor resistance to light |
| Comparative Example 2 | 97 | ○ | 1.6/1.6 | Δ | 35/30 | poor thermosensitivity |
| Comparative Example 3 | 100 | ◎ | 1.5/1.4 | x | 22/15 | poor thermosensitivity |

*1: Blur of image was occurred during preservation.

The results in the Table 1 clearly indicate that the receiving materials of the present invention exhibit such desirable characteristics as good thermosensitivity and good resistance to sticking even when recorded by an n-fold speed mode multiple recording method, and that the recorded images have good light resistance.

Obviously, additional modifications and variations of the present invention are possible in light of the above teachings. It is therefore to be understood that within the scope of the appended claims, the invention may be practiced other than as specially described herein.

What is claimed is:

1. A sublimation thermal transfer receiving material having a receiving layer useful for sublimation thermal transfer recording in which said sublimation thermal transfer receiving material is superimposed with a sublimation thermal transfer recording material so that said receiving layer contacts an ink layer of said sublimation thermal transfer recording material while heat is applied to said sublimation thermal transfer recording material to form an image on said receiving layer, said receiving layer comprises a resin having activated hydrogen, an isocyanate compound and a catalyst promoting the crosslinking reaction of said resin and said isocyanate compound, a degree of gelation of said receiving layer being about 70 to 99% and said isocyanate compound comprising one of a xylylene diisocyanate compound and an aliphatic isocyanate compound other than an adduct of hexamethylene diisocyanate.

2. The sublimation thermal transfer receiving material of claim 1, wherein said isocyanate compound comprises a derivative of one of xylylene diisocyanate, isophorone diisocyanate and hydrogenated xylylene diisocyanate.

3. The sublimation thermal transfer receiving material of claim 1, wherein said isocyanate compound comprises an adduct of xylylene diisocyanate.

4. The sublimation thermal transfer receiving material of claim 1, wherein said isocyanate compound comprises at least one of a monomer having a velocity constant or secondary velocity constant in the reaction with 1-butanol of less than about $10^5$ and a derivative of the monomer.

5. The sublimation thermal transfer receiving material of claim 1, wherein said isocyanate compound comprises an adduct of hydrogenated xylylene diisocyanate.

6. The sublimation thermal transfer receiving material of claim 1, wherein said isocyanate compound comprises an oxadiazinetrione derivative of hexamethylene diisocyanate.

7. The sublimation thermal transfer receiving material of claim 1, wherein said isocyanate compound comprises one of an adduct of isophorone diisocyanate and a trimer of isophorone diisocyanate.

8. The sublimation thermal transfer receiving material of claim 1, wherein said catalyst is a tin-containing compound.

9. The sublimation thermal transfer receiving material of claim 1, wherein said resin having activated hydrogen comprises one of polyester and vinyl chloride-vinyl acetate copolymer.

10. The sublimation thermal transfer receiving material of claim 1, wherein said receiving layer further comprises one of an antioxidant, a photostabilizer and an ultraviolet absorbing agent.

11. The sublimation thermal transfer receiving material of claim 10, wherein said photostabilizer is a compound which does not react with said isocyanate compound.

12. The sublimation thermal transfer receiving material of claim 1, wherein said sublimation thermal transfer receiving material comprises one of paper, synthetic paper and plastic film having a thickness of 0.1 to 3 mm.

13. A sublimation thermal transfer recording method comprising performing sublimation thermal recording in which a sublimation thermal transfer receiving material having a receiving layer which comprises a resin having activated hydrogen, an isocyanate compound which comprises one of a xylylene diisocyanate compound and an aliphatic isocyanate compound other than an adduct of hexamethylene diisocyanate and has a degree of gelation of about 70 to 99% is superimposed with a sublimation thermal transfer recording material so that the receiving layer faces an ink layer of the sublimation thermal transfer recording material and fed at a speed faster than the sublimation thermal transfer recording material while heat is applied to the sublimation thermal transfer recording material to form an image on the receiving layer.

14. The sublimation thermal transfer recording method of claim 13, wherein said sublimation thermal transfer recording method further comprises a heat treatment step in which heat is applied to the receiving layer of the sublimation thermal transfer receiving material after the image is formed on the receiving layer.

15. The sublimation thermal transfer recording method of claim 14, wherein said sublimation thermal transfer method further comprises a protective layer forming step in which a protective layer comprising an ultraviolet absorbing agent is formed on the receiving layer.

16. The sublimation thermal transfer recording method of claim 14, wherein said sublimation thermal transfer recording method further comprises a protective layer forming step in which a protective layer comprising an ultraviolet absorbing agent is formed on an adhesive layer which comprises one of an ultraviolet absorbing agent, an antioxidant and a photostabilizer and is formed on the receiving layer.

17. The sublimation thermal transfer recording method of claim 14, wherein said heat treatment is carried out with one of a heat roller and a ceramic heater.

18. The sublimation thermal transfer recording method of claim 13, wherein said sublimation thermal transfer method further comprises a protective layer forming step in which a protective layer comprising an ultraviolet absorbing agent is formed on the receiving layer.

19. The sublimation thermal transfer recording method of claim 18, wherein the protective layer comprises a resin having relatively low dye receivability.

20. The sublimation thermal transfer recording method of claim 13, wherein said sublimation thermal transfer recording method further comprises a protective layer forming step in which a protective layer comprising an ultraviolet absorbing agent is formed on an adhesive layer which comprises one of an ultraviolet absorbing agent, an antioxidant and a photostabilizer and is formed on the receiving layer.

21. The sublimation thermal transfer recording method of claim 20, wherein at least one of the protective layer and the adhesive layer comprises a resin having a relatively low dye receivability.

* * * * *